United States Patent [19]

O'Brien

[11] 4,387,896

[45] Jun. 14, 1983

[54] SLIDABLE GOLF PRACTICE DEVICE

[76] Inventor: John P. O'Brien, 175 E. Delaware Pl., Chicago, Ill. 60611

[21] Appl. No.: 285,585

[22] Filed: Jul. 21, 1981

Related U.S. Application Data

[63] Continuation-in-part of Ser. No. 195,403, Oct. 9, 1980, Pat. No. 4,311,312, which is a continuation-in-part of Ser. No. 35,605, Apr. 26, 1979, abandoned, which is a continuation-in-part of Ser. No. 932,563, Aug. 10, 1978, abandoned.

[51] Int. Cl.[3] ..... A63B 69/36

[52] U.S. Cl. ..... 273/195 A; 273/187 B

[58] Field of Search ..... 273/195 A, 183 A, 195 R, 273/195 B, 176 H, 176 J, 186 R, 186 C

[56] References Cited

U.S. PATENT DOCUMENTS

| | | | |
|---|---|---|---|
| 3,423,096 | 1/1969 | Tone | 273/195 A |
| 3,712,628 | 1/1973 | Boss | 273/195 A |
| 4,130,283 | 12/1978 | Lindquist | 273/195 A |

*Primary Examiner*—George J. Marlo

*Attorney, Agent, or Firm*—Cook, Wetzel & Egan

[57] ABSTRACT

A synthetic grass hitting surface is slidably positioned within a rectangular frame and is supported by a static surface. The sides of the frame and the static surface form slots. Sideward extensions of the base of the hitting surface are snuggly fitted into the slots. The hitting surface is adapted to slide horizontally on the static surface when a golf ball is struck from the hitting surface, but the snug fit of the side extensions of the hitting surface in the slots and the drag of the hitting surface over the static surface causes resistance to displacement of the hitting surface.

9 Claims, 4 Drawing Figures

SLIDABLE GOLF PRACTICE DEVICE

The present application is a continuation-in-part of Ser. No. 195,403 filed Oct. 9, 1980, now U.S. Pat. No. 4,311,312 which is a continuation-in-part of Ser. No. 035,605 filed Apr. 26, 1979 (now abandoned), which is a continuation-in-part of application Ser. No. 932,563 filed Aug. 10, 1978 (now abandoned).

The present invention relates generally to a golf practice device, and more particularly to a golf practice mat which includes a horizontally slidable golf ball hitting surface, positioned within a static frame, and supported by a static surface having a relatively slippery surface. In its preferred embodiment, the frame is positioned on a base mat and adjacent to a stance mat having a raised foot placement area which provides a place to stand which is coplanar or level with the golf ball hitting surface. The golf practice device of the present invention is adapted for hitting either conventional golf balls or plastic golf balls for instructional or for practice purposes, either indoors or out of doors, in any environment wherein a golf club can be swung.

A variety of golf mats and other golf practice devices have been proposed by the prior art which attempt to simulate grass surface on a mat for repeated and extended golf swing practice for use at golf driving ranges. Typical of such prior art pads are stationary or fixed position mats with door-mat-like construction, some of which are overlaid with synthetic grass such as Astro turf or other brush-like bristles attached to base mats. However, such stationary (fixed position) pads attached to such mats have at least three disadvantages: (1) the "feeling" transmitted to a golfer on hitting a golf ball off such a stationary (fixed) pad is a poor simulation of the feel of hitting a golf ball under natural turf conditions, i.e., natural turf gives way and moves forward at club impact with the ball, (2) the fixed pad hitting surfaces are not coplanar with the stance area of the mat, and (3) the simulated grass surface pad, fixed on a stationary mat base, wears rapidly because it provides no pad give or movement at club impact, thus entailing expensive and frequent replacement.

Some prior art devices such as shown by U.S. Pat. No. 3,423,096 have attempted to overcome the unnatural feeling, but such pad devices which employ springs under the hitting surface require a vertical space under the hitting surface for the springs. Such devices are not adapted to being implaced readily on the golf swing practice base mats now in use; nor are they readily adaptable for use indoors on the living room floor as is the subject matter of this application.

The present invention overcomes such problems in providing a slidable, artificial turf hitting surface which is supported by a static surface within a stationary frame, which permits a natural-feeling, forward-sliding, horizontal movement of the hitting surface when the club impacts with the surface at impact with the golf ball. The golf club, as it approaches the golf ball in the swing, is moving primarily in a horizontal direction, but with slight downward component. The ideal golf shot is executed by hitting the ball first and the turf thereafter. The pad of the present invention will accommodate the horizontal component of the impact by sliding horizontally and will accommodate the downward component of the swing at impact through compression of the fibers of the synthetic grass. The hitting surface pad is preferably held in position by horizontal extensions which fit in a slot formed between the static surface and the side members of the rectangular frame which surrounds the hitting surface area. The slot connection of the hitting surface permits the entire hitting surface to slide forward in a horizontal plane over the static surface when the club impacts with the ball along the line of flight of the golf ball, thus producing simulated turf conditions. The hitting surface is then manually returned to its original position.

The present invention also provides for the absorption of impact from swings which are not moving exactly along the intended line of flight of the golf ball (i.e., a swing of the club which will usually result in a hook or a slice). Although the major component of such a swing is principally horizontal along the intended line of flight (and is absorbed by the sliding action of the hitting surface), a portion of the force of the off line component is absorbed by compression of the fibers of the hitting surface against the side of the rectangular frame. This compression of the fibers at the edge of the hitting surface distributes the wear between the edges and the impact point, while providing, at the same time, a more natural turf-like feel for the user.

It has been found that the horizontally slidable hitting surface of the present invention provides a hitting surface which transmits a natural feel to the golfer, i.e., the feeling experienced by the golfer in making a proper swing at club impact with the ball taking a natural divot which occurs in a properly executed fairway iron shot. Moreover, the slidable structure of the present invention provides a long useful life or reduced wear because the moveable, synthetic grass, hitting surface slides forward at club impact with the ball, thus reducing the damage caused by the club impact force against the moveable hitting surface as compared to a stationary-type mat.

The object of the present invention is to provide a golf practice device adaptable to existing mats which includes sufficient area for hitting all golf shots either indoors or outdoors and which is also readily adaptable for mounting on small mats for practicing pitch and chip shots in any environment which a golf club can be swung.

The advantages of the present invention will be more fully understood by references to the drawings, in which.

Figure 1:
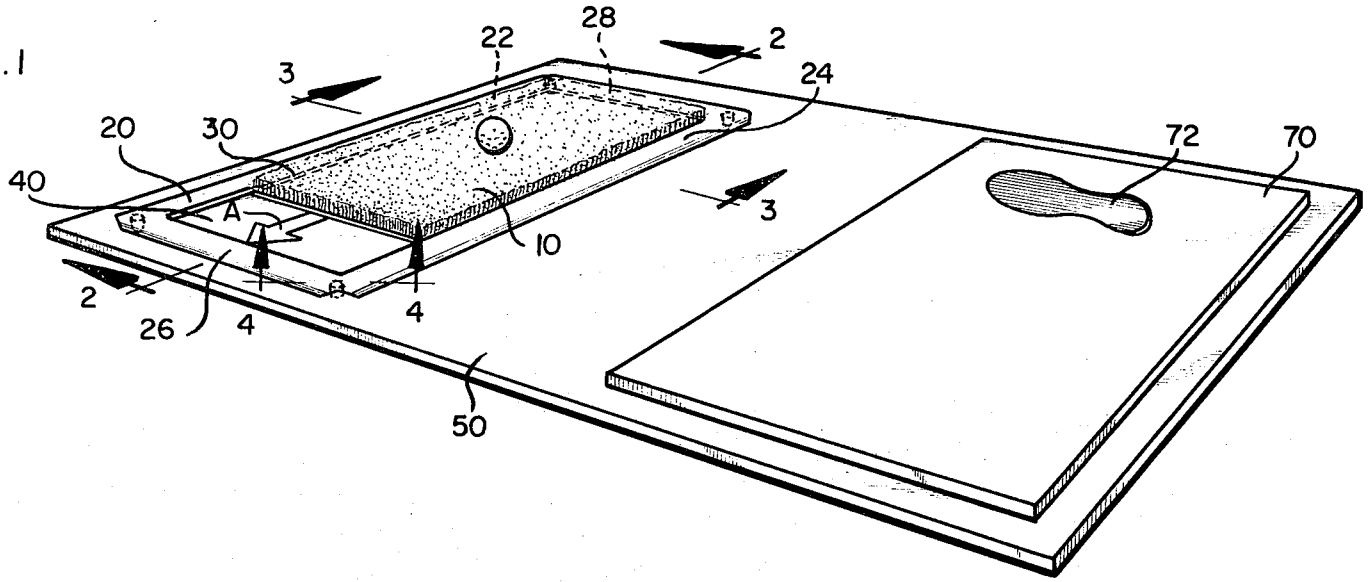
FIG. 1 is an isometric view of the improved golf practice device with the slidable hitting surface mounted on a full-sized base mat.

The slidable golf practice device of the present invention is shown in FIG. 1 generally at 10. The device generally comprises a static frame 20 and a horizontally slidable hitting surface 30 disposed within frame 20 and a static surface 40 having a relatively slippery surface disposed beneath and supporting said slidable hitting surface 30. In the preferred embodiment, as is shown in FIG. 1, the slidable golf practice mat 10 is mounted on a full-sized base mat 50.

Figure 4:
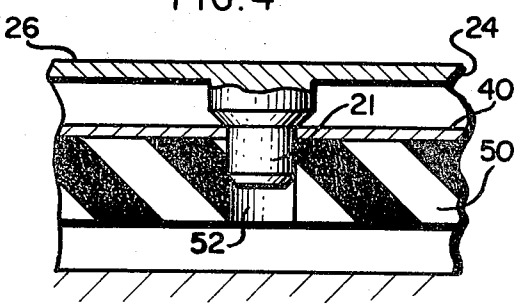
FIG. 4 is a partial side view of the frame securing means taken in section along line 4—4.

Having reference to FIG. 1, frame 20 is preferably rectangular in shape, although it may be square, comprising two side rails 22 and 24 and two end rails 26 and 28, and is designed to remain stationary while the golf ball is struck. Frame 20 is preferably fabricated from a metal, such as steel, but may also be fabricated from wood, plastic, or the like. Optional pins 21, shown in FIG. 4, located at the corners of frame 20 are adapted to engage holes 52 in base mat 50 to facilitate holding the frame stationary.

Figure 3:
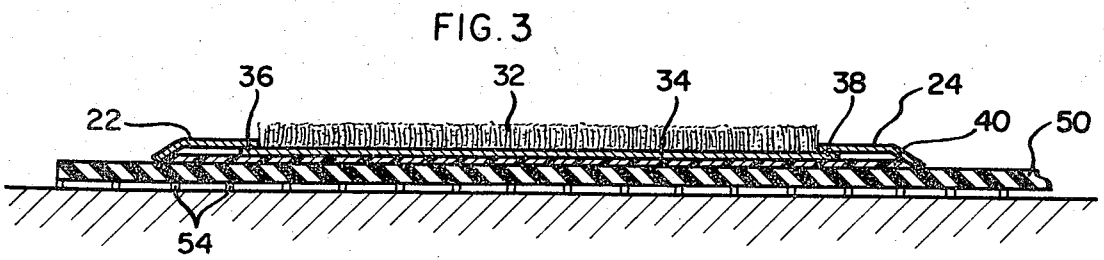
FIG. 3 is an end view of the improved golf practice device shown in FIG. 1 taken in section along lines 3—3.

Static surface 40 functions as a support for the hitting surface 30 and presents a low friction interface which enables hitting surface 30 to readily slide on static surface 40. Preferably the static surface 40 is fabricated from a low coefficient of friction plastic such as polypropylene, polytetrafluoroethylene or the like. Static surface 40 may be secured to frame 20 if desired. Alternatively, it may be secured to base mat 50. Static surface 40 cooperates with side rails 22 and 24, as is shown in FIG. 3 to form a pair of slots extending horizontally along the length of side rails 22 and 24.

The hitting surface 30 must be large enough to support a golf ball and provide a target for the person hitting the golf ball. A hitting surface 10 inches by 20 inches has proved useful, but larger or smaller surfaces may be used. It is essential that the hitting surface 30 be relatively rigid, so that it does not fold over and crease (and fly out of the frame) when hit with a golf club.

The hitting surface 30 preferably comprises a plurality of grass-like bristles 32 affixed to base member 34. Base member 34 is adapted to contact and slide upon static surface 40. In the preferred embodiment, the coefficient of friction of base member 34 with respect to static surface 40 is relatively low, in order to facilitate the easy sliding movement of hitting surface 30. Base member 34 includes two horizontal extensions 36 and 38, on opposite sides, adapted to engage the slots formed between side rails 22 and 24 and static member 40. The extensions 36 and 38 which extend beneath the side rails 22 and 24 are adapted to hold the slidable hitting surface within frame 20, yet permit hitting surface 30 to slide back and forth between end rails 26 and 28. The distance that extensions 36 and 38 extend beneath side rails 22 and 24 may vary over wide limits. The extensions 36 and 38 may be a portion of base member 34, wherein a portion of or all of the bristles 32 are cut away, or the extensions may be fabricated from a different material which is affixed to the edges of hitting surface 30. In the preferred embodiment, the bristles 32, in the area between the side rails 22 and 24, extend above the level of the rectangular frame 20, whereby the frame members are unlikely to be hit by the golf club.

Figure 2:
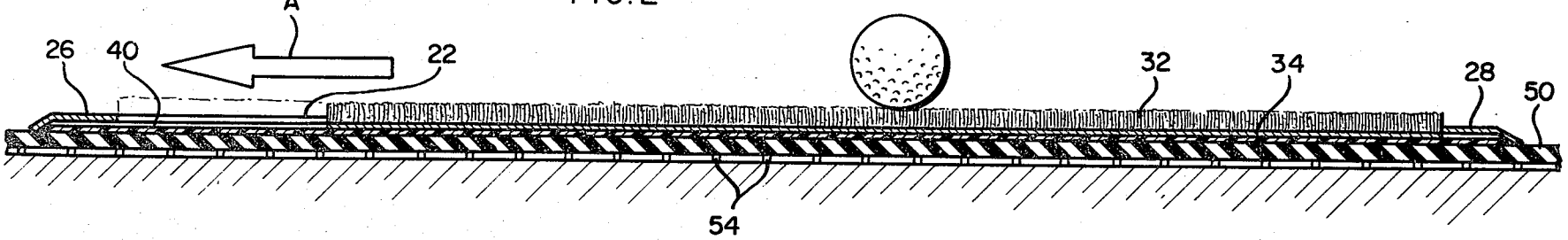
FIG. 2 is a side view of the improved golf practice device shown in FIG. 1, taken in section along lines 2—2.

In the preferred embodiment, the present invention includes a base mat 50 which is vertically compressible, to some extent, so that when a golf ball is struck from the slidable hitting surface, added vertical movement, i.e., vertical compression, is possible. In the preferred embodiment the slidable golf practice device 10 is secured to the base mat 50. As is shown in FIGS. 2 and 3, the base mat may be constructed from a plastic surface which is supported in part by spaced cylindrical pier members 54. This type structure permits base mat 50 to be vertically depressed between the pier members 54, which are spaced apart, when a golf ball is struck from the hitting surface. When a golf ball is struck from the hitting surface, frequently the golf club has a downward movement as well as a forward movement. In such cases, a more natural feel is obtained if the hitting surface has a vertical compressibility in addition to a forward horizontal slidability. The vertical compressibility is improved somewhat by the use of a compressible base mat of the type shown in FIGS. 2 and 3. Those skilled in the art will appreciate that foamed substrates and the like may be used as base mat 50 to provide the desired vertical compressibility.

The hitting surface 30, which comprises the hitting surface for the preferred embodiments, is an artificial grass-type surface which may be composed of a wide variety of artificial grass or brush-like surfaces wherein vertically disposed leaf-like bristles 32 are affixed to horizontal base 34 in such a manner that the bristles 32 retain a vertical attitude. It is preferred that the bristles 32 be long enough to rise above any hardware portion of the practice device 10, such as side members 22 and 24. Base 34 must be sufficiently tough to retain by adhesion or other means bristles 32 when struck by a golf club. Base 34 may be constructed out of any available materials and may be either a single layer of material as shown in FIG. 2 or 3 or a plurality of layers in order to provide the requisite strength and desired coefficient of friction. Preferably the lower surface of base 34 has a relatively low coefficient of friction which will permit it to move horizontally and slide over static surface 40 when struck by the golf club. It is important that hitting surface 30 be of smaller size than the inner dimensions of frame members 22 and 24, whereby hitting surface 30 is able to move along the line of flight of the ball, as shown by arrow A in FIG. 1, from end rail 28 to end rail 26.

As was mentioned above, the compressibility of the bristles 32 of the hitting surface 30 against side members 36 or 38 distribute the force of impact of the off-line swings, thus providing for more even wear and more natural turf-like feel for the user.

The present invention contemplates the use of the practice device 10 with the horizontally moveable hitting surface 30 in combination with a foot placement area 70 wherein the ball hitting surface 30 and the foot placement surface are level, i.e., they are located on the same horizontal plane. The preferred co-planar disposition of the hitting surface 30 and the foot placement surface 70 may be readily seen from FIG. 1. One of the major purposes of the present invention is to provide a golfer with a device on which he can consistently practice his golf swing. In order to eliminate as many as possible variables which affect the swing, it is deemed advantageous to provide a golfer with a foot placement area which is precisely level with the ball hitting surface. The co-planar disposition, for example, permits the user to grip each club in identical position and to assume the same stance on practice shot after practice shot eliminating any necessity to variably choke down on the club which would be required if the hitting surface was higher than the height of base mat 50 or the stance area. This requires the use of a pad 70, of the type shown in FIG. 1 in order to produce a co-planar hitting area and foot placement area. Pad 70 may be provided with a canted foot implacement device 72 of the type described in applicant's U.S. Pat. No. 4,164,352.

The present invention contemplates the use of the golf practice device in multiple sizes and varied environments, although in the preferred embodiment, the golf practice device is employed on a larger base mat 50 as shown in FIG. 1. Alternatively, the golf practice device of the present invention may be installed on an ordinary driving range mat wherein the device may be either temporarily installed, or permanently installed, using securing means known to those skilled in the art. Further, the golf practice device of the present invention may be used without any base mat, i.e., by placing it on any horizontal surface, wherein static surface 40 rests on the floor or the ground. The mat 50 may be of any size, i.e., it may be of the conventional driving range size, shown in FIG. 1. Alternatively, the mat 50 may be about the size of frame 20, which smaller sized unit may be conveniently used in any environment particularly for practicing shots with the short irons.

The forms of invention shown and described herein are to be considered only as illustrative. It will be apparent to those skilled in the art that numerous modifications may be made therein without departing from the spirit of the invention or the scope of the appended claims.

I claim:

1. A golf practice device adapted to be disposed on a horizontal surface, said device comprising:

a stationary, horizontal, rectangular frame;

a golf ball hitting surface slidably positioned within said frame;

a static surface adapted to support said hitting surface;

said frame comprising two side rails and two end rails, with said hitting surface disposed therebetween but spaced from said end rails;

said side rails spaced apart from said static surface thereby forming slot means generally aligned with the direction of the line of flight of the golf ball to be struck from said hitting surface; and said slot means adapted to cooperate with and frictionally engage the sides of said hitting surface to retain said hitting surface within said frame and to permit said hitting surface to slide horizontally over said static surface within said frame and provide a uniform resistance against displacement when a golf ball is struck from the hitting surface and thereafter permit said hitting surface to be manually returned to its original position.

2. A golf practice device as described in claim 1 wherein the static surface has a low coefficient of friction with respect to the underside of said golf ball hitting surface.

3. A golf practice device adapted to be disposed on a horizontal surface, said device comprising;

a stationary, horizontal, rectangular frame;

a golf ball hitting surface slidably positioned within said frame; and a static surface disposed beneath and supporting said hitting surface;

said frame comprising two side rails and two end rails, said hitting surface disposed between and adjacent to said side rails, but spaced apart from said end rails, said side rails being spaced above said static surface, thereby forming a pair of horizontal slots parallel to said side rails; and said hitting surface including horizontal extensions at each side adjacent to said side rails, said extensions adapted to cooperate with and frictionally engage said slots and permit said hitting surface to slide horizontally along said side rails, between said end rails, whereby said hitting surface is adapted to slide horizontally over said static surface within said frame and provide a uniform resistance against displacement when a golf ball is struck from the hitting surface.

4. A golf practice device as described in claim 3 wherein the static surface has a low coefficient of friction with respect to the underside of said golf ball hitting surface.

5. A golf practice device as described in claim 3 in combination with a base mat, and mounted thereon.

6. A golf practice device as described in claim 5 which includes securing means adapted to removably affix said frame in a stationary position.

7. A golf practice device as described in claim 5 which includes an elevated foot placement area having an upper surface coplanar with the upper surface of said golf ball hitting surface mounted on the said stationary base mat.

8. A golf practice device as described in claim 3 wherein said hitting surface comprises a synthetic grass surface.

9. A golf practice device as described in claim 8 wherein said hitting surface comprises a synthetic grass composed of vertically disposed bristles mounted on a horizontal base.

* * * * *